US012194369B2

(12) United States Patent
Dumas

(10) Patent No.: US 12,194,369 B2
(45) Date of Patent: Jan. 14, 2025

(54) SKATEBOARD TRUCK WITH ADJUSTABLE PLANE OF ROTATION

(71) Applicant: Waterborne Skateboards Inc., Costa Mesa, CA (US)

(72) Inventor: Patrick Lee Dumas, San Pedro, CA (US)

(73) Assignee: Waterborne Skateboards Inc., Costa Mesa, CA (US)

( * ) Notice: Subject to any disclaimer, the term of this patent is extended or adjusted under 35 U.S.C. 154(b) by 265 days.

(21) Appl. No.: 17/871,809

(22) Filed: Jul. 22, 2022

(65) Prior Publication Data

US 2024/0024759 A1 Jan. 25, 2024

(51) Int. Cl.
*A63C 17/01* (2006.01)

(52) U.S. Cl.
CPC ..... *A63C 17/012* (2013.01)

(58) Field of Classification Search
CPC ..... A63C 17/012
See application file for complete search history.

(56) References Cited

U.S. PATENT DOCUMENTS 4,251,087 A * 2/1981 Hansen ..... A63C 17/01 280/11.28
5,522,620 A 6/1996 Pracas
6,793,224 B2 9/2004 Stratton
6,979,007 B1 12/2005 Hosoda
7,287,762 B2 10/2007 Stratton
7,810,825 B2 10/2010 Cole
7,828,306 B2 11/2010 Stratton
10,864,430 B2 12/2020 Dumas
11,511,179 B2 11/2022 Dumas
2001/0038187 A1* 11/2001 Reyes ..... A63C 17/01 280/11.25
2002/0125670 A1* 9/2002 Stratton ..... A63C 17/01 280/87.041
2006/0097470 A1* 5/2006 Chmelar ..... A63C 17/0093 280/87.042

(Continued)

FOREIGN PATENT DOCUMENTS

WO 01/60467 A1 8/2001

OTHER PUBLICATIONS

European Application No. 19186382.8, Search Report, Jan. 9, 2020.

(Continued)

*Primary Examiner* — Brian L Swenson
(74) *Attorney, Agent, or Firm* — Joseph A. Andelin; Fish IP Law, LLP

(57) ABSTRACT

A skateboard truck with a swinging arm having an adjustable plane of rotation is described. The truck has a base plate rotatably coupled with a pivoting plate via a pivot assembly. The pivot assembly comprises (i) a bolt about which the swinging arm of the pivoting plate rotates, (ii) an optional centering or biasing member that biases the pivoting plate from an off-center position to a center position, and (iii) a tapered spacer removably disposed between the base plate and pivoting plate. The tapered spacer couples with the pivoting plate in at least two different radial positions to create different angles between the skateboard and swinging arm for different riding styles and user preferences.

19 Claims, 13 Drawing Sheets

*(neutral position)*

*(greater-than-neutral position)*

(56) References Cited

U.S. PATENT DOCUMENTS

| | | | | |
|---|---|---|---|---|
| 2007/0164530 | A1* | 7/2007 | Horn | A63C 17/01 280/87.042 |
| 2012/0068428 | A1* | 3/2012 | Visinski | A63C 17/0093 280/87.042 |
| 2013/0175774 | A1 | 7/2013 | Lininger, Jr. | |
| 2013/0270781 | A1* | 10/2013 | Kuyt | A63C 17/012 280/11.27 |
| 2015/0097352 | A1 | 4/2015 | Ivazes | |
| 2015/0224386 | A1* | 8/2015 | Baldauf | A63C 17/012 280/124.103 |
| 2018/0193721 | A1 | 7/2018 | Martinez Almansa | |
| 2020/0179791 | A1* | 6/2020 | Williams, Jr. | A63C 17/015 |

OTHER PUBLICATIONS

"Carver C7 Truck," Carver Skateboards Online Shop, [retrieved on Apr. 14, 2020] <URL: https://shop.carverskateboards.com/collections/trucks/products/carver-c7-truck>, 2 pages.
"Smoothstar Thursters," [retrieved on Apr. 14, 2020, <URL: https://smoothstar.com.au/product-category/smoothstar-thrusters/>, 9 page.
"Yow System", [retrieved on Apr. 14, 2020], <URL: https://yowsurf.com/yow-system/>, 4 page.

* cited by examiner

*(neutral position)*

*(less-than-neutral position)*

*(greater-than-neutral position)*

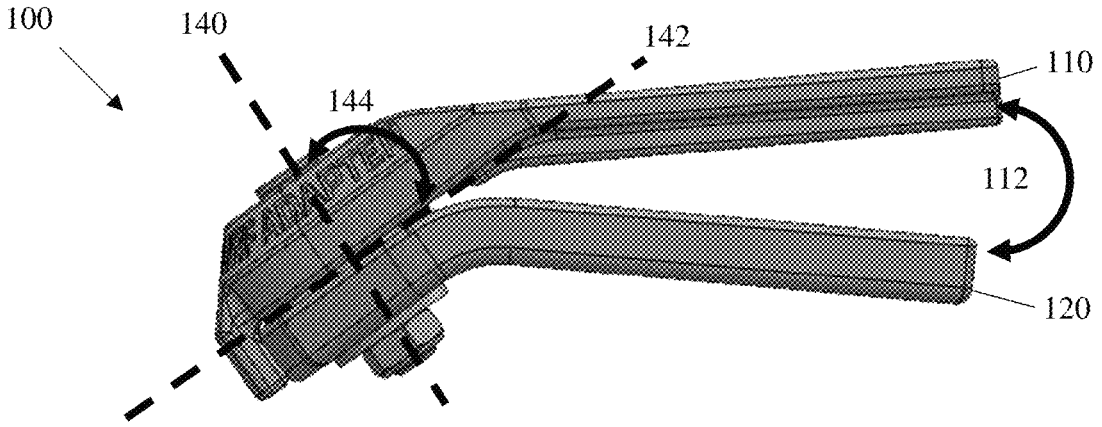
*FIG. 8* *(neutral position)*
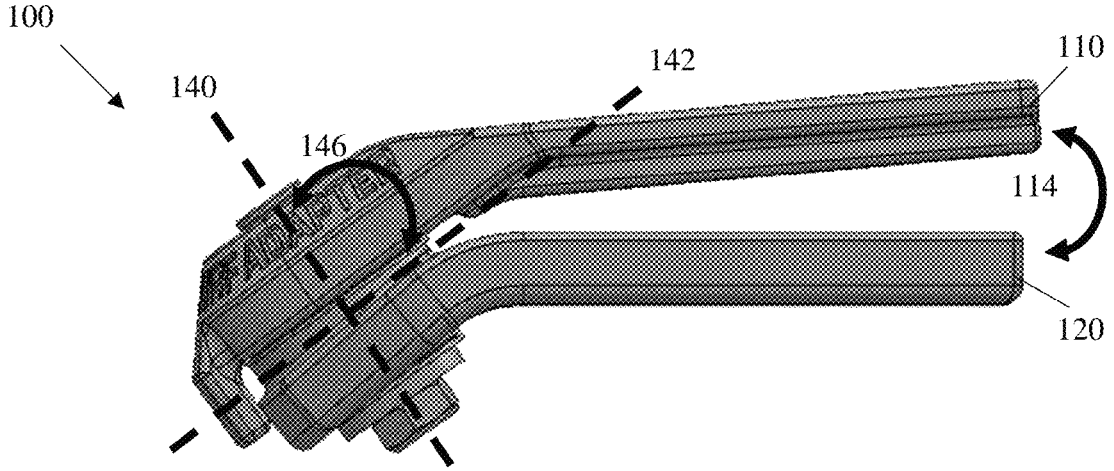
*FIG. 9* *(less-than-neutral position)*
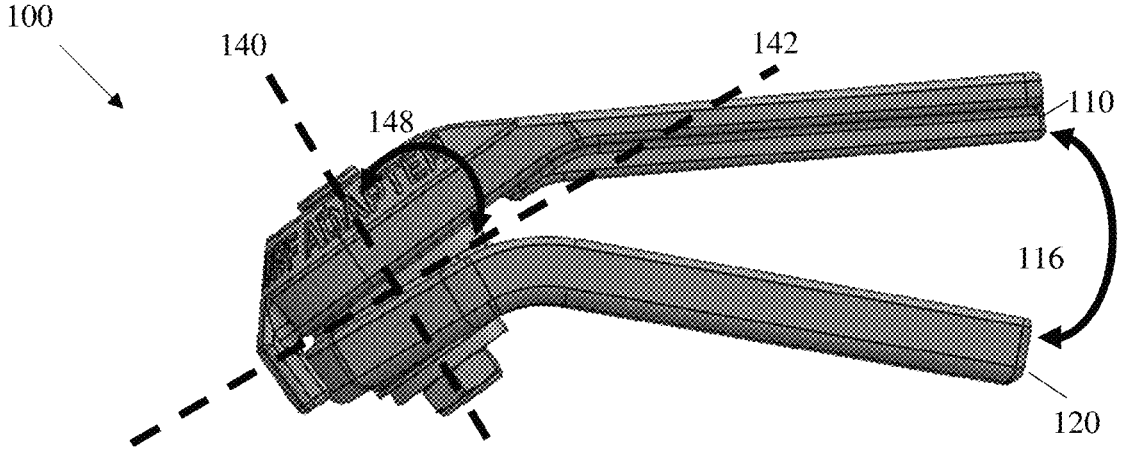
*FIG. 10* *(greater-than-neutral position)*

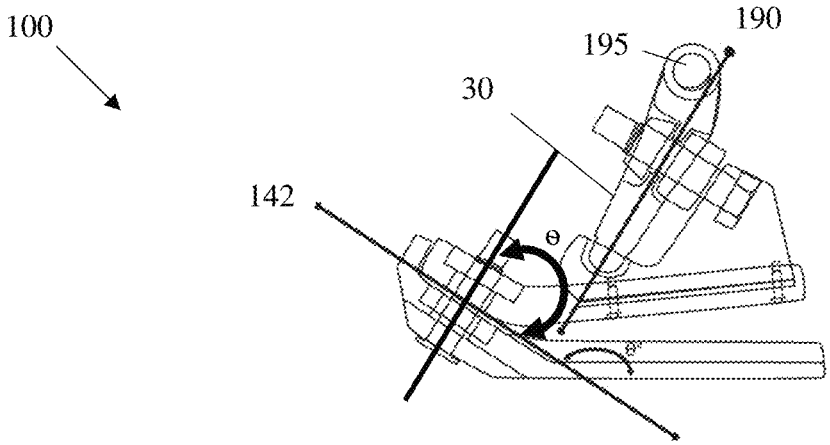
*FIG. 11* *(neutral position)*
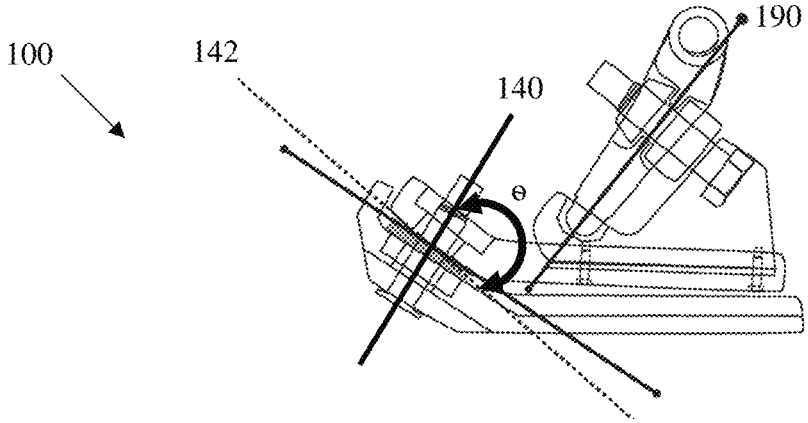
*FIG. 12* *(less-than-neutral position)*
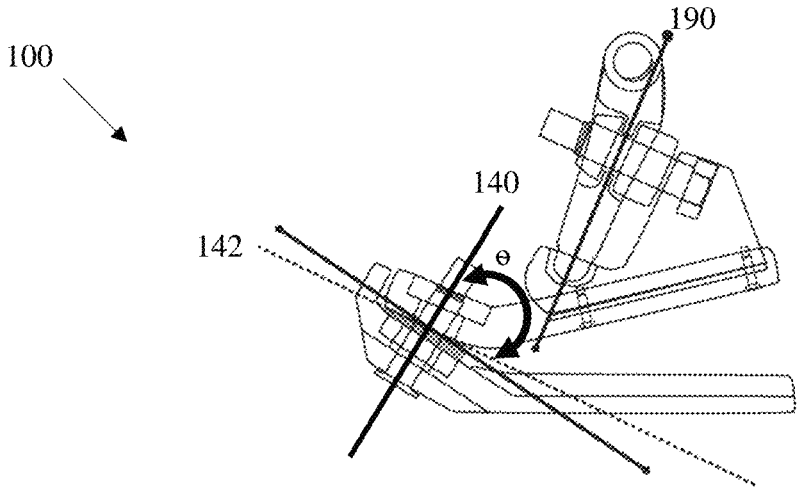
*FIG. 13* *(greater-than-neutral position)*

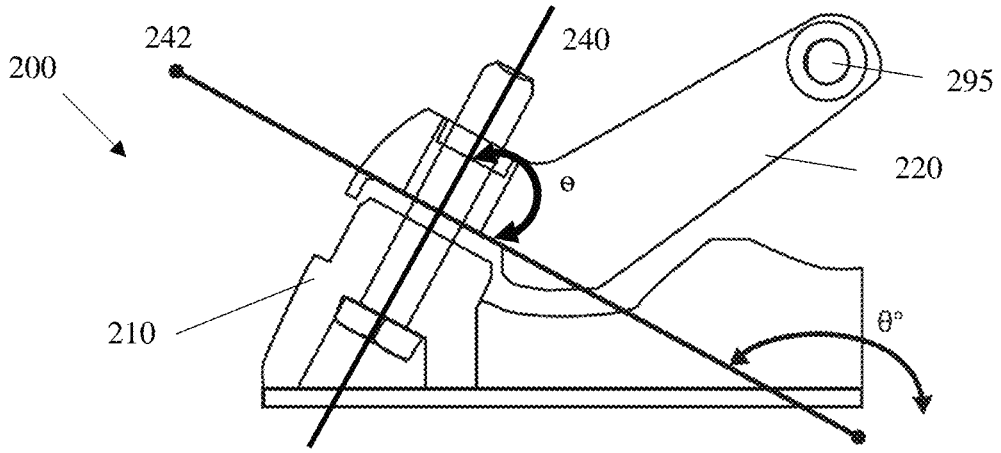
*FIG. 14* *(neutral position)*
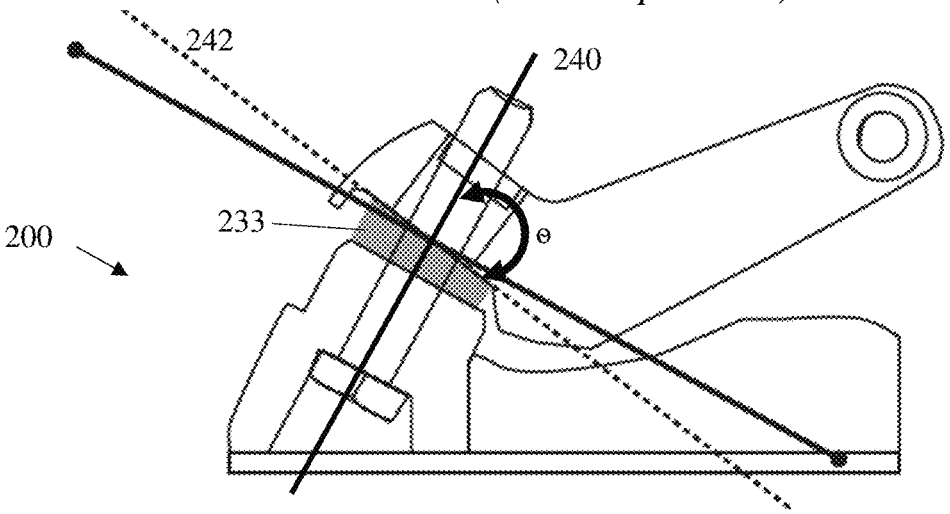
*FIG. 15* *(less-than-neutral position)*
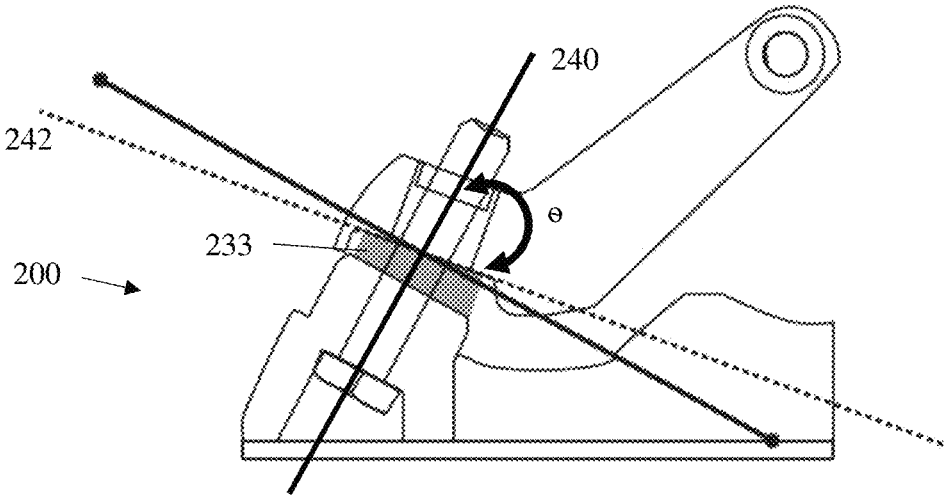
*FIG. 16* *(greater-than-neutral position)*

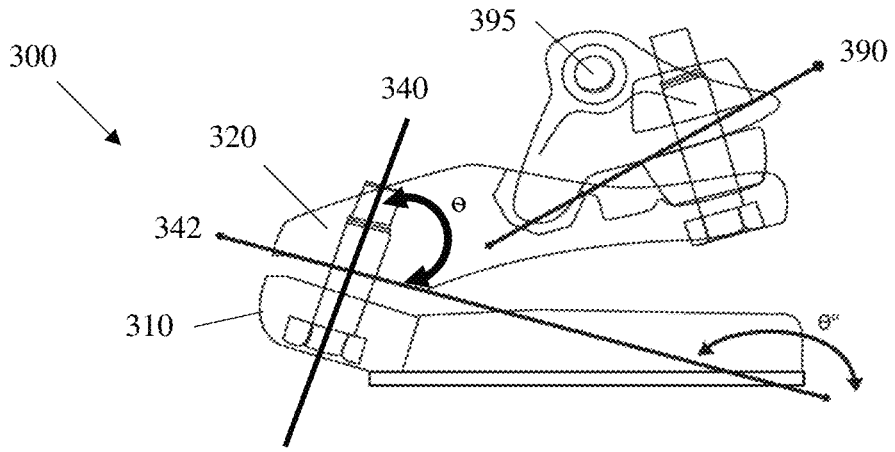
*FIG. 17*(*neutral position*)
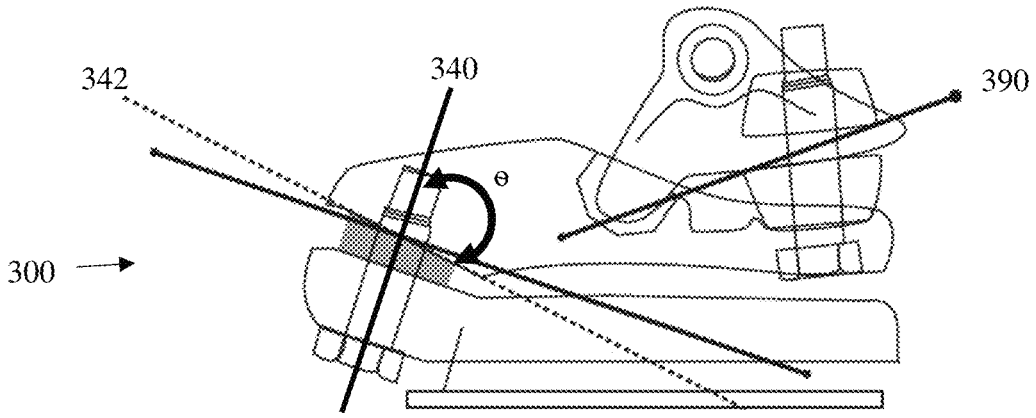
*FIG. 18* (*less-than-neutral position*)
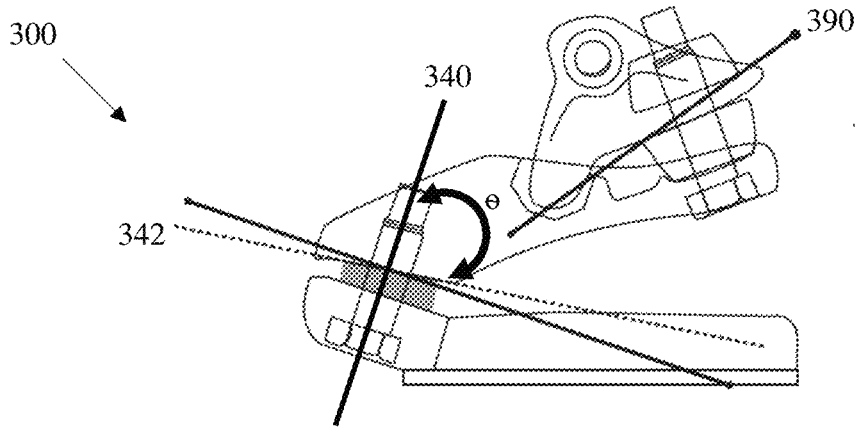
*FIG. 19*(*greater-than-neutral position*)

SKATEBOARD TRUCK WITH ADJUSTABLE PLANE OF ROTATION

FIELD OF THE INVENTION

The field of the invention is skateboard trucks, more specifically, truck carrying members with an adjustable swinging arm.

BACKGROUND

The background description includes information that may be useful in understanding the present invention. It is not an admission that any of the information provided herein is prior art or relevant to the presently claimed invention, or that any publication specifically or implicitly referenced is prior art.

Skateboards have been around for a long time and different riders have introduced different riding styles over the years. Today's skateboard riders desire an enhanced performance with respect to maneuverability over traditional skateboard configurations. Unfortunately, traditional skateboard trucks are designed for street skating and aerial tricks, and do not provide enhanced maneuverability for a superior riding experience.

Some have attempted to redesign traditional skateboards by providing a dual pivot truck with side-to-side movement. For example, U.S. Pat. No. 5,522,620 to Pracas titled "Truck For A Rideable Vehicle, Such As A Skateboard" teaches a truck design that has a second pivotal member (e.g., swinging arm) to allow for "to and fro type swinging motion." Col. 4, line 46. While the swinging arm in Pracas provides another degree of freedom, the plane of rotation is parallel to the direction of motion (i.e., deck). This design makes it difficult to control the board especially during extreme turns or at high speeds, since it does not provide a centering (i.e., biasing) mechanism. In addition, the plane of rotation is fixed at a parallel angle and cannot be adjusted. The angle of the rotational plane dictates the ratio of lean and turn for the truck. Pracas' fixed plane of rotation therefore fails to accommodate different rider preferences who may desire different ratios of lean to turn for different applications and riding styles.

These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

As another example, U.S. Pat. No. 6,793,224 to Stratton titled "Truck for Skateboards" tries to simulate the dynamics of a surfboard with a skateboard truck with a centering mechanism. Col. 2, line 3. Unlike Pracas, the second axis of rotation is "oblique to the direction of motion." Col. 6, line 12. Moreover, the centering mechanism in Stratton is overly complex and requires numerous parts, including a spring-loaded link, a link pin, and a heavy-duty compression spring. Col. 7, lines 45-50. The complex design is not durable and fails to provide a natural and smooth transition between turns. Moreover, like Pracas, Stratton has a fixed plane of rotation and fails to accommodate different user preferences.

U.S. Pat. No. 10,864,430 to Dumas titled "Surf Adapter Mechanism For Skateboards" teaches a truck carrying member that has a second axis of rotation and can be used with a conventional truck. In addition, the truck carrying member has a centering mechanism that provides a natural and smooth transition between turns. However, the axis of rotation and the angle of the swinging arm on the truck carrying member is not adjustable.

Thus, there is still a need for a skateboard truck that provides an axis of rotation and that has a swinging arm with adjustable rotational plane that allows the user to configure the skateboard for different riding styles or applications.

SUMMARY OF THE INVENTION

The present inventive subject matter provides apparatus, systems, and methods in which a skateboard truck provides an adjustable pivoting plane to accommodate different riding styles and advantages to the rider.

The skateboard truck comprises a base plate rotatably coupled with a swinging arm. The base plate has a mounting surface that forms an obtuse angle with a pivoting surface. The mounting surface of the base plate is configured to removably couple with a skateboard.

The swinging arm has a mounting surface that forms an obtuse angle with a pivoting surface. The mounting surface has an axle and wheels that can either be permanently or removably coupled thereto. The pivoting surface of the swinging arm is rotatably coupled with the pivoting surface of the base plate. The pivoting surface of the swinging arm defines a pivoting plane within which the pivoting surface rotates.

The pivoting surface of the base plate and the pivoting surface of the swinging arm rotatably couple together via a pivot assembly comprising: (i) a bolt about which the two pivoting surfaces rotate with respect to one another, (ii) an optional centering or biasing member that biases the swinging arm from an off-center position to a center position relative to a longitudinal dimension of the base plate, (iii) a first tapered spacer, and (iv) an optional second tapered spacer. In some configurations, the first tapered spacer couples with the pivoting surface of the swinging arm or the base plate and the second tapered spacer couples with the opposite side of the pivoting surface of the swinging arm. The pivot assembly defines a plane of rotation for the swinging arm and the truck axel.

In one aspect of some embodiments, the first tapered spacer is affixed to the pivoting surface of the swinging arm in a manner that prevents rotation of the first tapered spacer. For example, the first tapered spacer can have one or more elements that mechanically lock with the pivoting surface, such as one or more catches or protrusions extending outwardly from a bottom surface of the first tapered spacer that are sized and dimensioned to fit with one or more openings or holes in the pivoting surface. It is also contemplated that at least one of the protrusions passes complete through the swinging arm and to the other side to serve as an alignment indicator for the second tapered spacer. The protrusion that serves as an alignment feature can be longer than a second protrusion, which does not need to pass completely through the swinging arm.

In another aspect of some embodiments, the second tapered spacer has an alignment indicator to ensure proper assembly and placement. For example, the second tapered spacer can have an indent that is configured to receive a protrusion of the first tapered spacer.

The first and second spacers are designed to removably couple with the swinging arm in at least a first radial position and a second radial position. In either position the taper direction of the first tapered spacer is opposite the taper direction of the second tapered spacer. The first tapered spacer sets the desired angle between the pivoting surfaces of the base plate and swinging arm, and consequently, the desired angle between the mounting surface of the base plate and the swinging arm of the swinging arm. The second tapered spacer provides for a smooth and even rotation of the swinging arm relative to the base plate. In some embodiments, the first radial position and the second radial position are separated by 180 degrees.

It is also contemplated that the pivot assembly can be assembled and used without the inclusion of the first and second tapered spacers. In this configuration, the angle between the pivoting surfaces of the base plate and swinging arm are parallel and the angle between the mounting surface of the base plate the swinging arm of the swinging arm are said to be in a neutral position. When the first and second tapered spacers are installed in the first radial position, the angle between the pivoting surfaces of the base plate and swinging arm are not parallel and the angle between the mounting surface of the base plate the swinging arm of the swinging arm is said to be in a less-than-neutral position. When the first and second tapered spacers are installed in the second radial position, the angle between the pivoting surfaces of the base plate and swinging arm are not parallel and the angle between the mounting surface of the base plate and swinging arm of the swinging arm is said to be in a greater-than-neutral position. In some embodiments, the angle between the long axis of the bolt and the pivoting surface of the swinging arm is about 90 degrees in the neutral position, between 45 degrees and 90 degrees in the less-than-neutral position, and between 90 degrees and 135 degrees in the greater-than-neutral position.

The first and second tapered spacers allows the user to adjust the angle between the mounting surface of the base plate and the swinging arm of the swinging arm for different riding styles. For example, in the first radial position (e.g., less-than-neutral position), the turn angle is decreased. The smaller turn angle is better for applications such as slalom racing, agile direction changes, and expert surfskate carving. In the second radial position (e.g., greater-than-neutral position), the turn angle is increased. The greater turn angle is better for long distance pumping, low effort self-propulsion, high speed stability, and basic surfskate carving. In the neutral position, the turn angle is moderate (albeit still greater than a conventional truck) and is good for a riding style that requires speed, maneuverability, and surfskate carving. In this manner, the inventive skateboard trucks disclosed herein provide better carving and maneuverability than a conventional truck while also allowing for adjustment of the turn angle to accommodate different riding styles.

Various objects, features, aspects, and advantages of the inventive subject matter will become more apparent from the following detailed description of preferred embodiments, along with the accompanying drawing figures in which like numerals represent like components. The drawing figures are embodiments (i.e., examples) described from the observer's perspective and may not be drawn to scale.

BRIEF DESCRIPTION OF THE DRAWING

FIG. 8 is right side view of the truck carrying member of FIG. 2 with the axis of rotation in a neutral position.

FIG. 9 is a right-side view of the truck carrying member of FIG. 2 with the axis of rotation in a less-than-neutral position.

FIG. 10 is right side view of the truck carrying member of FIG. 2 in a greater-than-neutral position.

FIG. 11 is a left side, upside down view of the truck carrying member and truck of FIG. 1A in a neutral position.

FIG. 12 is a left side, upside down view of the truck of FIG. 1A in a greater-than-neutral position.

FIG. 13 is a left side, upside down view of the truck of FIG. 1A in a less-than-neutral position.

FIG. 14 is a left side view of another embodiment of a truck in a neutral position.

FIG. 15 is a left side view of the truck of FIG. 14 in a greater-than-neutral position.

FIG. 16 is a left side view of the truck of FIG. 14 in a less-than-neutral position.

FIG. 17 is a left side view of another embodiment of a truck in a neutral position.

FIG. 18 is a left side view of the truck of FIG. 17 in a greater-than-neutral position.

FIG. 19 is a left side view of the truck of FIG. 17 in a less-than-neutral position.

DETAILED DESCRIPTION

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Figure 1A:
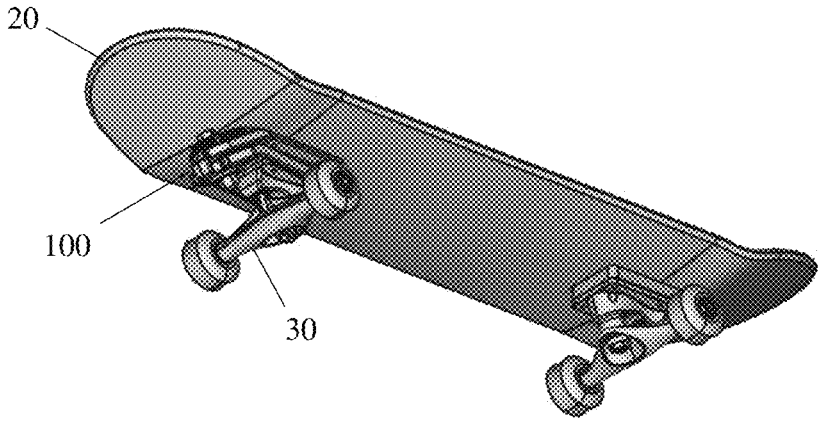
FIG. 1A is a front right bottom perspective view of a skateboard, truck, and truck carrying member.
Figure 1B:
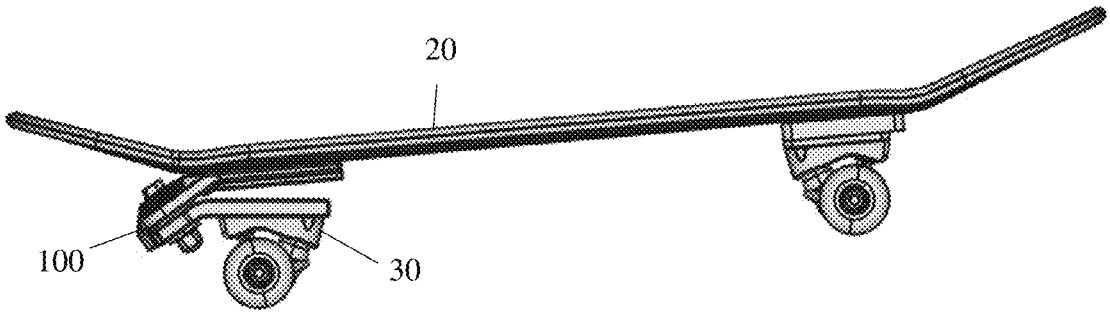
FIG. 1B is a right-side view of the skateboard, truck, and truck carrying member of FIG. 1A.

FIG. 1A shows a perspective view of a skateboard truck 100 coupled with a skateboard and a conventional truck 30. FIG. 1B shows a side view of the truck 100, skateboard 20, and conventional truck 30. Skateboard truck 100 shares many similarities with the truck carrying member 605 disclosed in FIGS. 22-25 in U.S. Pat. No. 10,864,430, which is incorporated herein by reference. However, unlike truck carrying member 605, skateboard truck 100 has a pivot assembly that allows for easy adjustment of the angle of the plane of rotation of the pivoting surface of the pivoting plane (i.e., the pivoting plane), and consequently, easy adjustment of the angle between the mounting surface of the base plate and swinging arm of the swinging arm. Adjustment of the pivoting plane helps to accommodate different riding styles and user preferences. Adjustment of the pivoting plane will now be discussed in further detail.

Figure 2:
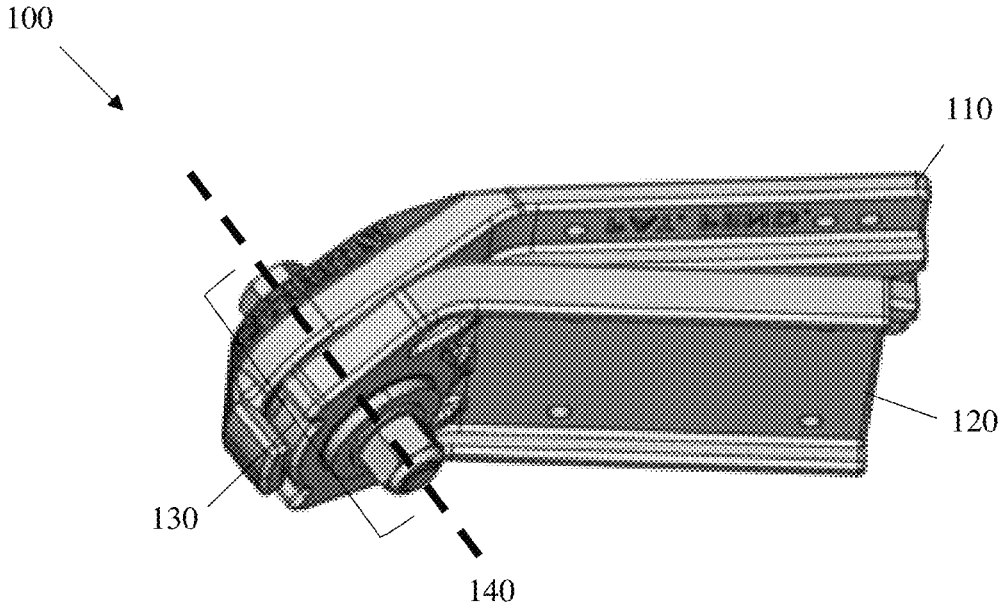
FIG. 2 is a front right bottom perspective view of the truck carrying member of FIG. 1A.
Figure 3:
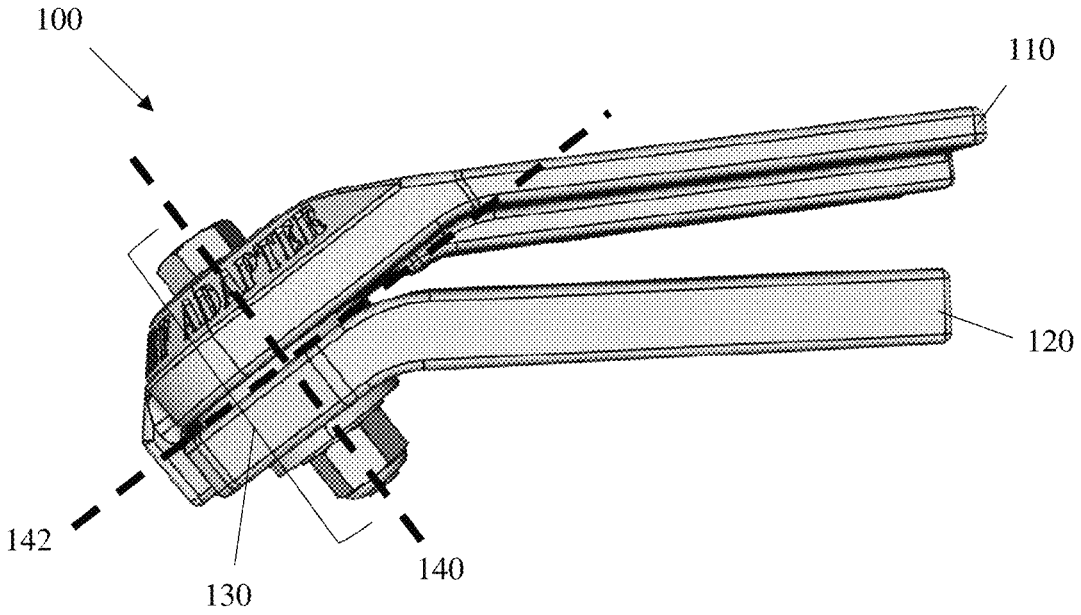
FIG. 3 is a right-side view of the truck carrying member of FIG. 2.

FIG. 2 shows a bottom side perspective view of truck 100 removed from skateboard 20 and conventional truck 30 (e.g., axle, wheels). FIG. 3 shows a side view of truck 100. Truck 100 has a base plate 110 and a swinging arm 120. Base plate 110 and swinging arm 120 both have a mounting surface and a pivoting surface as described in U.S. Pat. No. 10,864,430. The base plate 110 and swinging arm 120 are rotatably coupled via a pivot assembly 130. Pivot assembly 130 has an axis of rotation 140 and a plane of rotation 142. The axis of rotation 140 and plane of rotation 142 are perpendicular to one another in the neutral position when the first tapered spacer 133 and second tapered spacer 134 are not included.

Figure 4A:
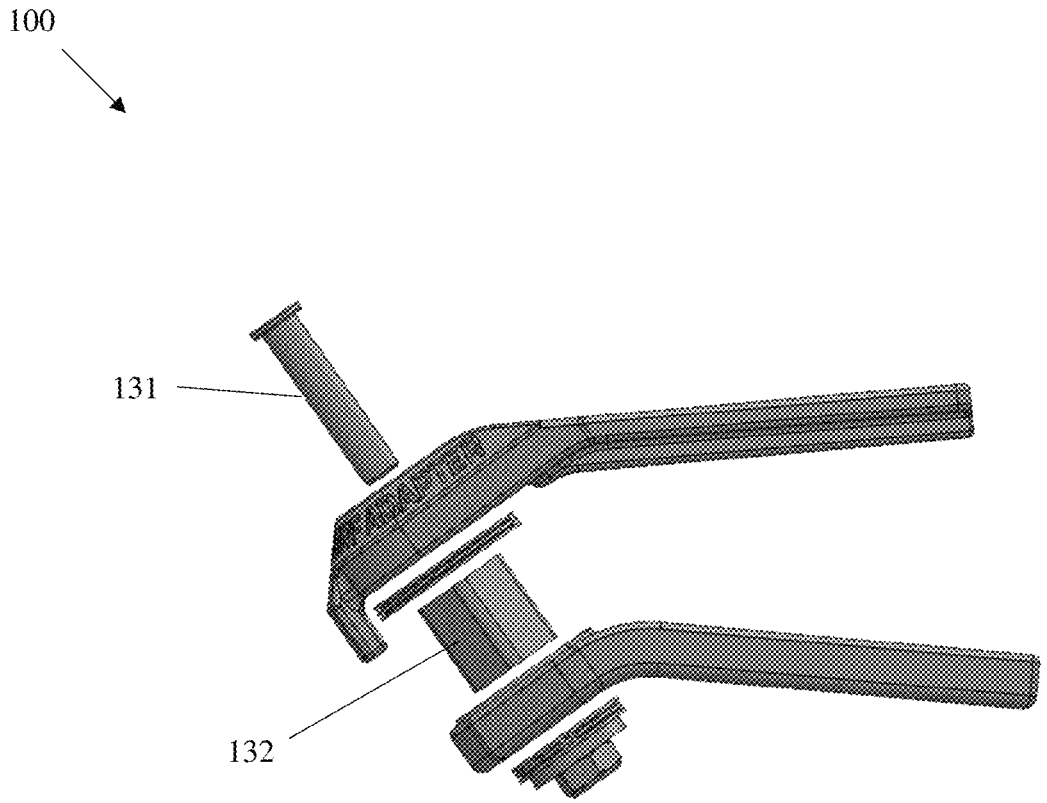
FIG. 4A is a right side exploded view of the truck carrying member of FIG. 2 with the axis of rotation adjusted at a neutral angle.

FIG. 4A shows an exploded view of truck 100 with pivot assembly 130 configured in a neutral position. Pivot assembly 130 comprises a bolt 131, an optional biasing member 132, and other components such as a nut, washers, and bearings. In the neutral position, first tapered spacer 133 and second tapered spacer 134 are removed.

Figure 4B:
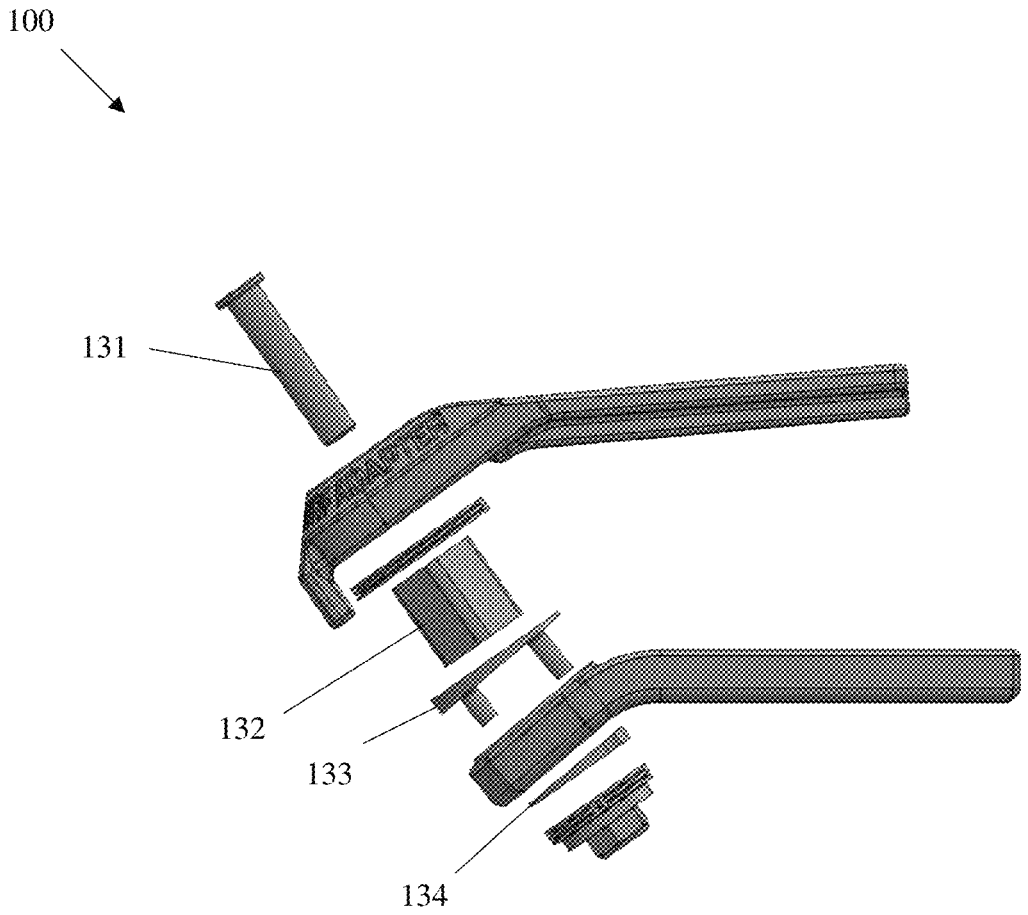
FIG. 4B is a right side exploded view of the truck carrying member of FIG. 2 with the axis of rotation adjusted at a less-than-neutral angle.

FIG. 4B shows an exploded view of truck 100 with pivot assembly 130 configured in a less-than-neutral position. Pivot assembly 130 comprises a bolt 131, an optional biasing member 132, a first tapered spacer 133, and an optional second tapered spacer 134. Pivot assembly 130 can also optionally include additional components such as a nut, washers, and bearings. When pivot assembly 130 is configured in the less-than-neutral position, first tapered spacer 133 and second tapered spacer 134 are disposed in a first radial position. The taper direction of the first tapered spacer 133 and second tapered spacer 134 are in opposite directions to provide a smooth and even rotation of swinging arm 120 about axis 140. For example, the thicker side of first tapered spacer 133 is located on the outside (e.g., front) of the truck 100 and the thicker side of the second tapered spacer 134 is located on the inside of the truck 100. It is also contemplated that first tapered spacer 133 can be used without the optional second tapered spacer 134.

Figure 4C:
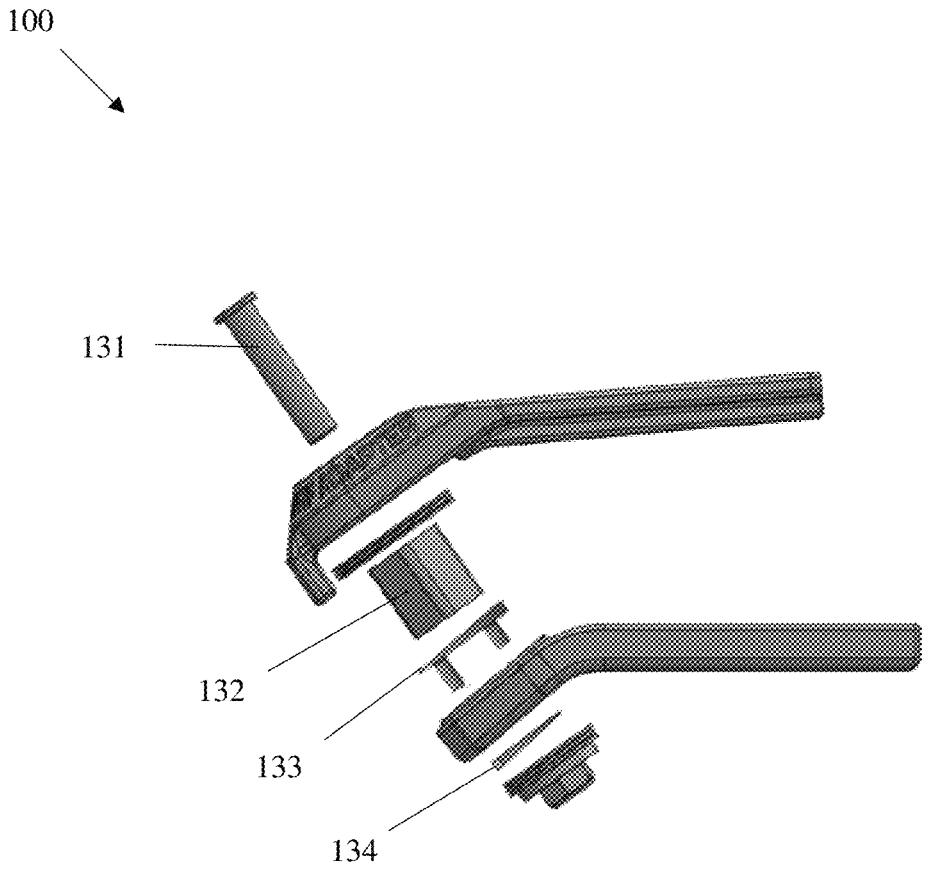
FIG. 4C is a right side exploded view of the truck carrying member of FIG. 2 with the axis of rotation adjusted at a greater-than-neutral angle.

FIG. 4C shows an exploded view of truck 100 with pivot assembly 130 configured in a greater-than-neutral position. In this position, first tapered spacer 133 and second tapered spacer 134 are disposed in a second radial position. The taper direction of the first tapered spacer 133 and second tapered spacer 134 are in opposite directions to provide a smooth and even rotation of swinging arm 120 about axis 140. For example, the thicker side of first tapered spacer 133 is located on the inside of the truck 100 and the thicker side of the second tapered spacer 134 is located on the outside (e.g., front) of the truck 100.

Figure 5A:
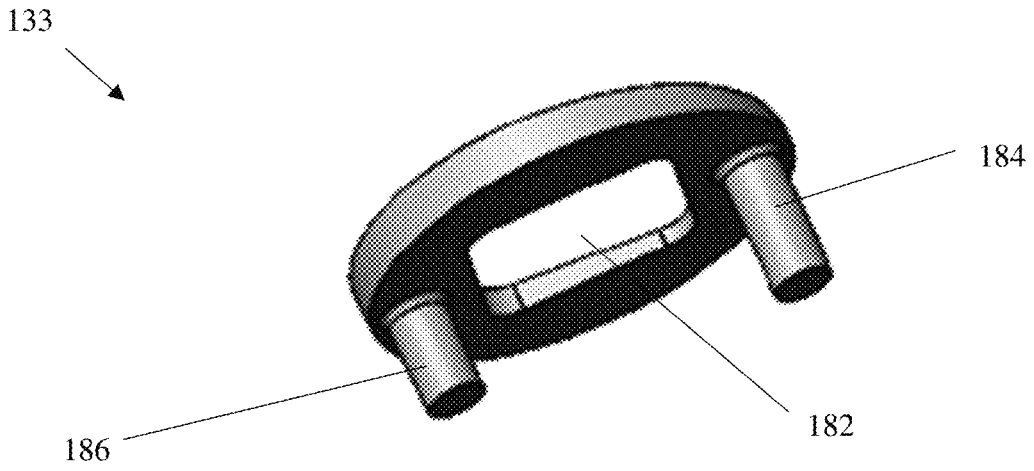
FIG. 5A is a bottom perspective view of the first tapered spacer of the truck carrying member of FIG. 2.
Figure 5B:
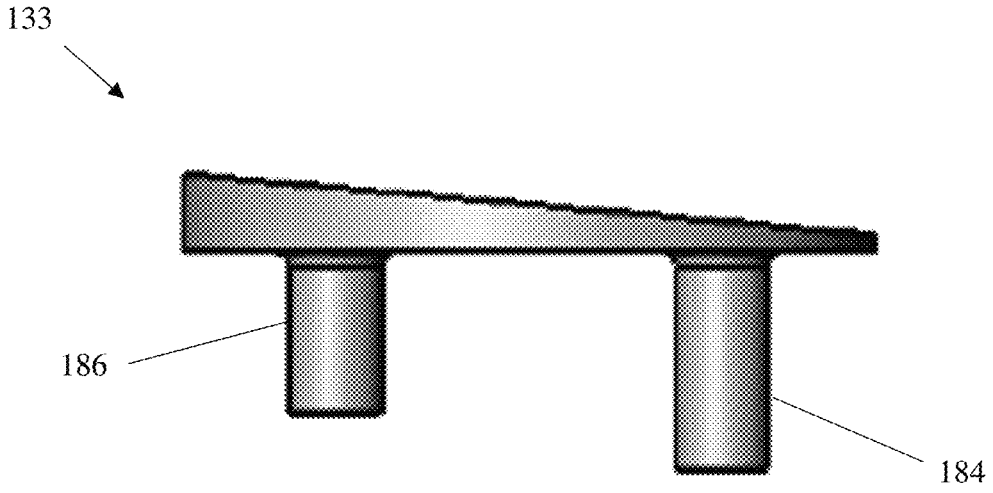
FIG. 5B is a right-side view of the first tapered spacer of the truck carrying member of FIG. 2.
Figure 5C:
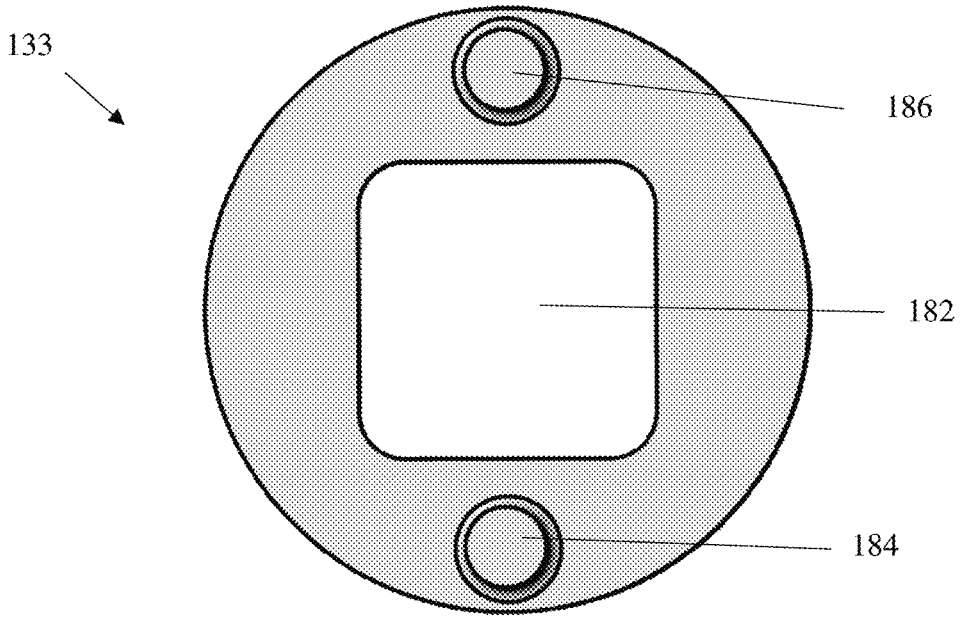
FIG. 5C is a bottom view of the first tapered spacer of the truck carrying member of FIG. 2.

FIG. 5A shows a bottom perspective view of first tapered spacer 133. FIG. 5B shows a side view of first tapered spacer 133. FIG. 5C shows a bottom view of first tapered spacer 133. First tapered spacer 133 has an opening 182, a first protrusion 184, and a second protrusion 186. Opening 182 has a shape that matches the cross section of biasing member 132. Protrusions 184 and 186 extend outwardly from the bottom surface of first tapered spacer 133. Protrusion 184 is longer than protrusion 186. Protrusion 184 is sized and dimensioned to pass completely through swinging arm 120.

Figure 6A:
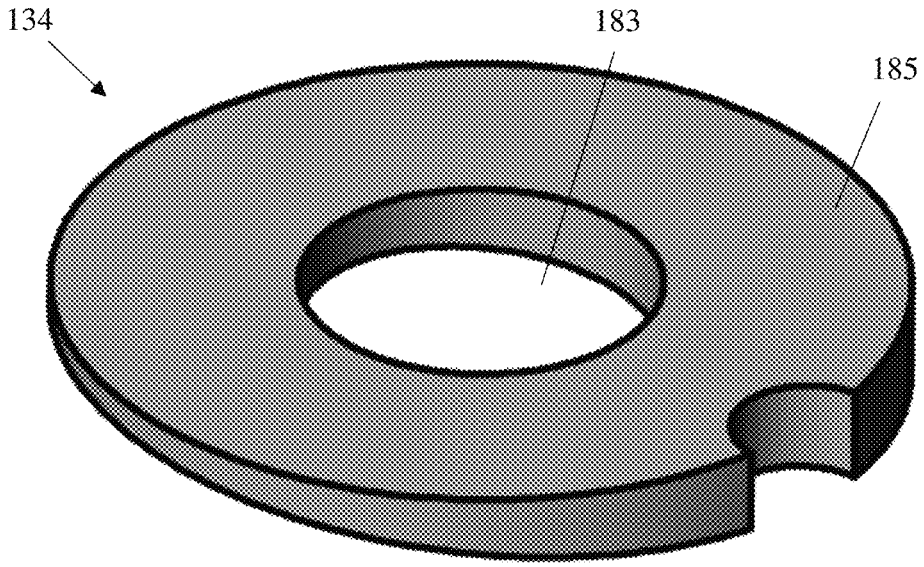
FIG. 6A is a bottom perspective view of the second tapered spacer of the truck carrying member of FIG. 2.
Figure 6B:
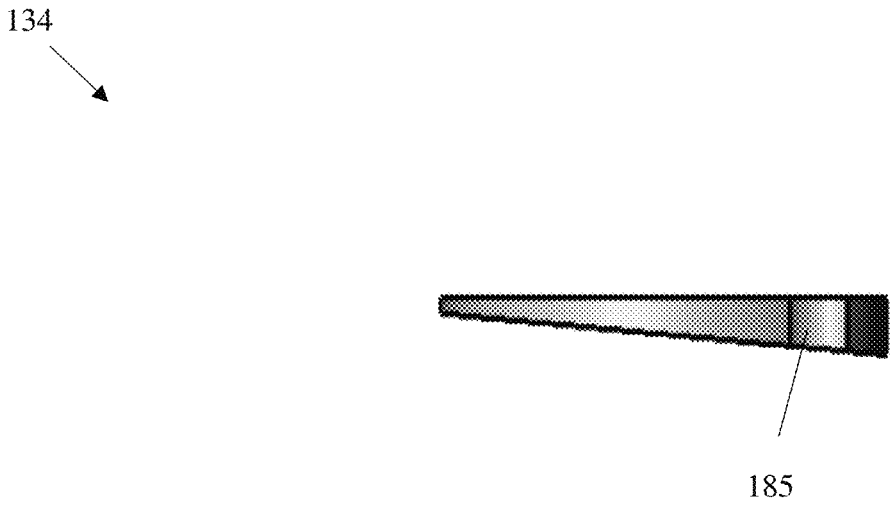
FIG. 6B is a right-side view of the second tapered spacer of the truck carrying member of FIG. 2.
Figure 6C:
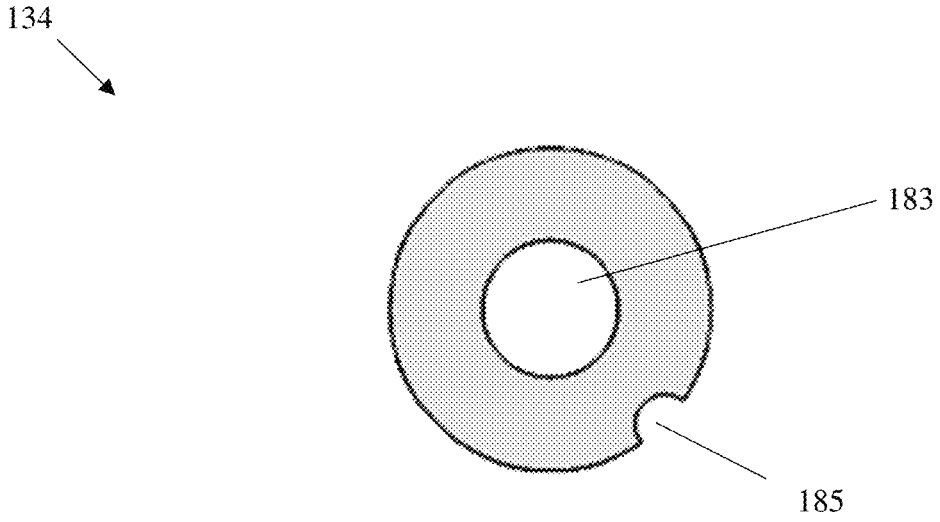
FIG. 6C is a bottom view of the second tapered spacer of the truck carrying member of FIG. 2.

FIG. 6A shows a top perspective view of second tapered spacer 134. FIG. 5B shows a side view of second tapered spacer 134. FIG. 6C shows a top view of second tapered spacer 134. Second tapered spacer 134 has an opening 183 and a notch 185. Opening 183 is sized and dimensioned to receive bolt 131. Notch 185 is sized and dimensioned to receive first protrusion 184.

First tapered spacer 133 removably couples with the pivoting surface 123 of swinging arm 120. Pivoting surface 123 faces towards the skateboard 20 and away from the ground. Second tapered spacer 134 removably couples with the bottom surface of swinging arm 120 on the opposite side of the pivoting surface 123, which faces away from skateboard 20 and towards the ground.

Figure 7A:
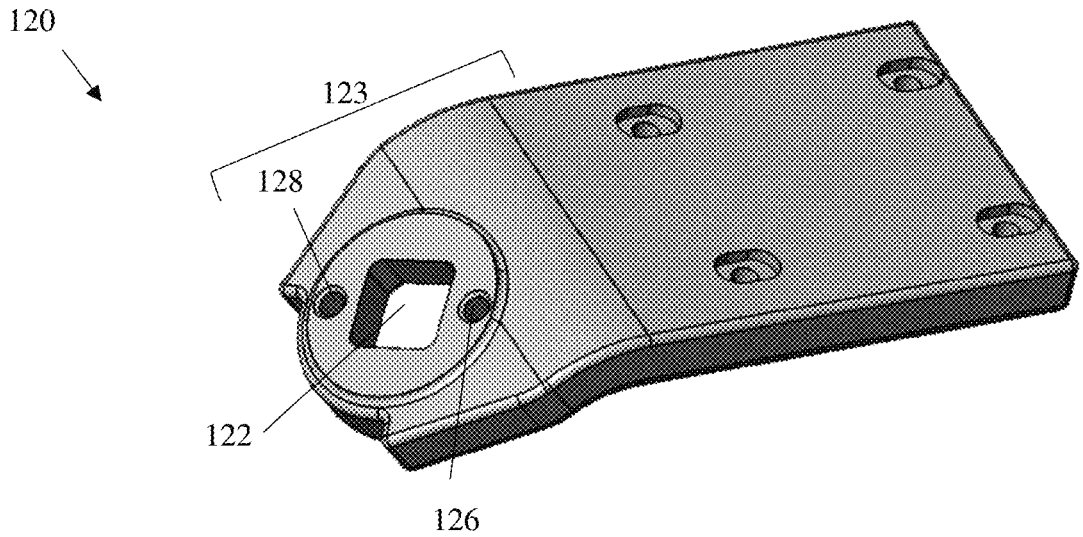
FIG. 7A is a top view of the pivoting surface of the swinging arm of the truck carrying member of FIG. 2.

FIG. 7A shows a top view of the pivoting surface 123 of swinging arm 120. The top side of swinging arm 120 has a pivoting surface 123 that rotatably couples with the pivoting surface of base plate 110. Swinging arm 120 has an opening 122 sized and dimensioned to receive biasing member 132. Swinging arm 120 also has openings 126, 128 sized and dimensioned to receive protrusions 184, 186.

Figure 7B:
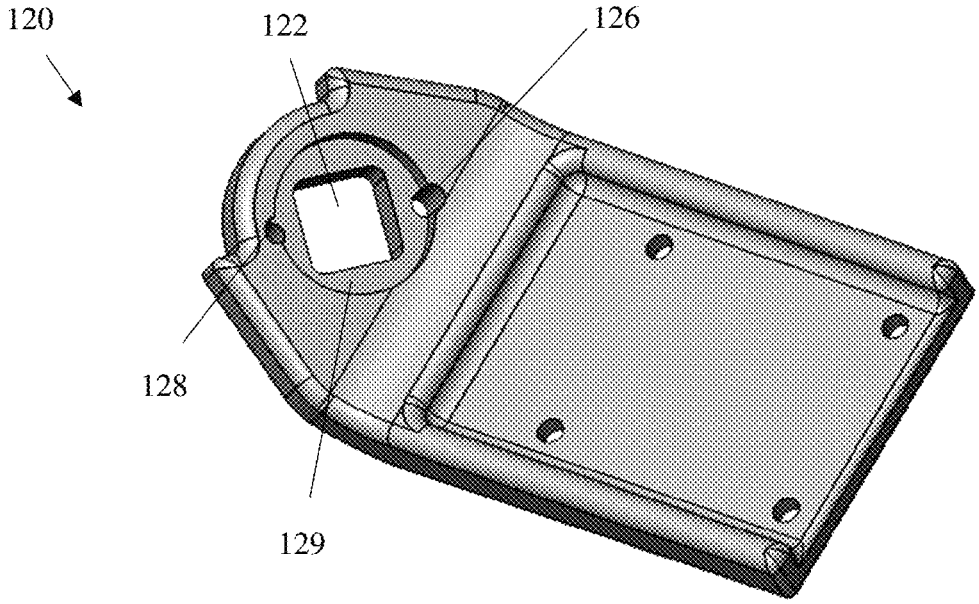
FIG. 7B is a bottom view of the swinging arm of the truck carrying member of FIG. 2.

FIG. 7B shows a bottom view of swinging arm 120. The bottom side of swinging arm 120 has a recess 129 sized and dimensioned to receive second tapered spacer 134.

FIG. 8 shows truck 100 without first tapered spacer 133 and second tapered spacer 134. The axis of rotation 140 and plane of rotation 142 form an angle 144 without first tapered spacer 133 and second tapered spacer 134 installed, which is about ninety degrees. The mounting surface of base plate 110 and swinging arm 120 form an angle 112, which defines the neutral position.

FIG. 9 shows truck 100 with first tapered spacer 133 and second tapered spacer 134 assembled in a first radial position. The axis of rotation 140 and plane of rotation 142 form an angle 146, which is less than ninety degrees when first tapered spacer 133 and second tapered spacer 134 are assembled in the first radial position. The mounting surfaces of base plate 110 and swinging arm 120 form an angle 114, which defines the less-than-neutral position. In this position, the thickest side of first tapered spacer 133 faces towards the outside of truck 100 and the thickest side of second tapered spacer 134 faces towards the inside of truck 100.

FIG. 10 shows truck 100 with first tapered spacer 133 and second tapered spacer 134 assembled in a second radial position. The axis of rotation 140 and plane of rotation 142 form an angle 148, which is greater than ninety degrees when first tapered spacer 133 and second tapered spacer 134 are assembled in the second radial position. The mounting surfaces of base plate 110 and swinging arm 120 form an angle 116, which defines the greater-than-neutral position. In this position, the thickest side of first tapered spacer 133 faces towards the inside of truck 100 and the thickest side of second tapered spacer 134 faces towards the outside of truck 100. First tapered spacer 133 and second tapered spacer 134 can be switched between the first radial position and the second radial position by rotating them 180 degrees to reposition their thickest sides.

In some embodiments, the angle between the long axis of the bolt and the pivoting surface of the swinging arm is about 90 degrees in the neutral position, between 45 degrees and degrees in the less-than-neutral position, and between 90 degrees and 135 degrees in the greater-than-neutral position. However, it is also contemplated that the neutral angle could be offset from 90 degrees. Moreover, the thickness of first tapered spacer 122 and second tapered spacer 134 can be selected accordingly on the user's preferences. It is contemplated that numerous interchangeable tapered spacers having different thicknesses can be provided in a kit and the user can select the desired thickness for the desired angle adjustment of the plane of rotation. It is also contemplated that the user can order a custom tapered spacer with the desired dimensions.

In the first radial position (e.g., less-than-neutral position), the turn angle is decreased. The smaller turn angle is better for applications such as slalom racing, agile direction changes, and expert surfskate carving. In the second radial position (e.g., greater-than-neutral position), the turn angle is increased. The greater turn angle is better for long distance pumping, low effort self-propulsion, high speed stability, and basic surfskate carving. In the neutral position, the turn angle is moderate (albeit still greater than a convention truck) and is good for a riding style that requires speed, maneuverability, and surfskate carving. Truck 100 advantageously provides better carving and maneuverability than a conventional truck while also allowing for adjustment of the turn angle to accommodate different riding styles.

FIGS. 11-13 show a left side, upside down view of truck 100 attached with conventional truck 30. Conventional truck 30 has a wheel axle 195 that rotates about an axis of rotation 190. FIG. 11 shows truck 100 in a neutral position where the plane of rotation 142 is perpendicular to the axis of rotation 140 without a spacer 133. FIG. 12 shows truck 100 in a less-than-neutral position where the plane of rotation 142 is greater than ninety degrees to the axis of rotation 140. FIG. 13 shows truck 100 in a greater-than-neutral position where the plane of rotation 142 is less than ninety degrees to the axis of rotation 140. The angle of the axis of rotation 190 is adjusted when plane of rotation 142 is adjusted. It is also contemplated that the distance between the swinging arm and wheel axle can be adjusted by providing different size spacers therebetween.

FIGS. 14-16 shows a truck 200 that comprises a base plate 210 rotatably coupled with a swinging arm 220 and a wheel axle 295 rigidly fixed to swinging arm 220. Unlike the swinging arm 120 of truck 100, swinging arm 220 is permanently attached to wheel axle 295. In addition, wheel axle 295 is rigidly fixed to swinging arm 220 and does not provide an axis of rotation like a conventional truck. Truck 200 is similar to truck 100 and truck 300 in that it has an adjustable plane of rotation 242. FIG. 14 shows truck 200 in a neutral position where the plane of rotation 242 is perpendicular to the axis of rotation 240 without a spacer 233. FIG. 15 shows truck 200 in a less-than-neutral position where the plane of rotation 242 is greater than ninety degrees to the axis of rotation 240 when spacer 233 is installed in a first position (e.g., thickest side of tapered spacer 233 faces towards the outside of truck 200). FIG. 16 shows truck 200 in a greater-than-neutral position where the plane of rotation 242 is less than ninety degrees to the axis of rotation 240 when spacer 233 is installed in a second position (e.g., thickest side of tapered spacer 233 faces towards the inside of truck 200).

FIGS. 17-19 shows a truck 300 that comprises a base plate 310 rotatably coupled with a swinging arm 320 and a wheel axle 395 integrated with swinging arm 320. Unlike wheel axle of 295 of swinging arm 220 of truck 200, swinging arm 320 is not rigidly fixed to swinging arm 320 and instead provides another axis of rotation 390. Unlike the axle of truck 30, which is referred to as a reverse kingpin truck, wheel axle 395 sits between the pivot cup and bushing assembly, and therefore has a lower profile than reverse kingpin trucks. The configuration of wheel axle 395 is commonly referred to as a traditional truck. Truck 300 is similar to truck 100 and swinging arm truck 200, in that it has an adjustable plane of rotation 342. FIG. 17 shows truck 300 in a neutral position where the plane of rotation 342 is perpendicular to the axis of rotation 240 without a spacer 233. FIG. 18 shows truck 200 in a less-than-neutral position where the plane of rotation 242 is greater than ninety degrees to the axis of rotation 240 when spacer 233 is installed in a first position (e.g., thickest side of tapered spacer 233 faces towards the outside of truck 200). FIG. 19 shows truck 200 in a greater-than-neutral position where the plane of rotation 242 is less than ninety degrees to the axis of rotation 240 when spacer 233 is installed in a second position (e.g., thickest side of tapered spacer 233 faces towards the inside of truck 200).

In some embodiments, the numbers expressing dimensions, angles, measurements, and so forth, are used to describe and claim certain aspects of the invention and are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary. The recitation of ranges of values herein is merely intended to serve as a shorthand method of referring individually to each separate value falling within the range. Unless otherwise indicated herein, each individual value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Thus, specific devices and methods of skateboard trucks have been disclosed. It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification or claims refer to at least one of something selected from the group consisting of A, B, C . . . and N, the text should be interpreted as requiring only one element from the group, not A plus N, or B plus N, etc.

What is claimed is:

1. A skateboard truck with an adjustable plane of rotation, comprising:

a base plate having (i) a first mounting surface for coupling with the skateboard and (ii) a first pivoting surface;

a swinging arm having (i) a second mounting surface with an axle either permanently or removably attached, and (ii) a second pivoting surface that forms an obtuse angle with the second mounting surface; and wherein the first pivoting surface and the second pivoting surface are rotatably coupled at a pivot assembly comprising a bolt about which the first and second pivoting surfaces rotate, and a first tapered spacer removably disposed between the first and second pivoting surfaces.

2. The truck of claim 1, wherein the first tapered spacer has a first protrusion and a second protrusion extending outwardly from a bottom surface of the first tapered spacer.

3. The truck of claim 2, wherein the second pivoting surface has a first opening sized and dimensioned to receive the first protrusion and a second opening sized and dimensioned to receive the second protrusion.

4. The truck of claim 3, further comprising a second tapered spacer removably disposed on a bottom surface of the swinging arm opposite the second pivoting surface, and wherein the second tapered spacer has a first indent sized and dimensioned to receive the first protrusion.

5. The truck of claim 4, wherein the first protrusion is longer than the second protrusion.

6. The truck of claim 1, wherein the first tapered spacer removably couples with the second pivoting surface in a first radial position and a second radial position.

7. The truck of claim 6, wherein the first radial position and the second radial position are separated by 180 degrees.

8. The truck of claim 7, further comprising a second tapered spacer that removably couples with a bottom surface of the swinging arm opposite to the second pivoting surface, wherein the second tapered spacer couples with the bottom surface in a first radial position and a second radial position that correspond with the first and second radial positions of the first tapered spacer, respectively.

9. The truck of claim 8, wherein the swinging arm is at a neutral position when the first and second tapered spacers are removed from the pivot assembly.

10. The truck of claim 9, wherein the swinging arm is at a less-than-neutral position when the first and second tapered spacers are coupled with the swinging arm in the first radial position.

11. The truck of claim 10, wherein the swinging arm is at a greater-than-neutral position when the first and second tapered spacers are coupled with the swinging arm in the second radial position.

12. The truck of claim 11, wherein the angle between the bolt and a pivoting plane of the second pivoting surface is about 90 degrees in the neutral position.

13. The truck of claim 12, wherein the angle between the bolt and the pivoting plane of the second pivoting surface is between 45 degrees and 90 degrees in the less-than-neutral position.

14. The truck of claim 13, wherein the angle between the bolt and the pivoting plane of the second pivoting surface is between 90 degrees and 135 degrees in the greater-than-neutral position.

15. The truck of claim 1, wherein the second pivoting surface has a first recess or opening that is sized and dimensioned to snugly receive a biasing member that biases the swinging arm from an off-center position to a center position relative to a longitudinal dimension of the base plate.

16. The truck of claim 15, wherein the first pivoting surface has a second recess or opening that is sized and dimensioned to snugly receive the biasing member.

17. The truck of claim 16, wherein the biasing member has a non-circular cross-section.

18. The truck of claim 15, wherein the biasing member is sufficiently flexible to allow the swinging arm to rotate at least 15 degrees off-center in both directions.

19. The truck of claim 1, wherein the axle is removably coupled with the swinging arm.

* * * * *